US007017684B2

(12) United States Patent
Blange

(10) Patent No.: US 7,017,684 B2
(45) Date of Patent: Mar. 28, 2006

(54) JET CUTTING DEVICE WITH DEFLECTOR

(75) Inventor: Jan Jette Blange, Rijswijk (NL)

(73) Assignee: Shell Oil Company, Houston, TX (US)

( * ) Notice: Subject to any disclaimer, the term of this patent is extended or adjusted under 35 U.S.C. 154(b) by 110 days.

(21) Appl. No.: 10/469,893

(22) PCT Filed: Mar. 6, 2002

(86) PCT No.: PCT/EP02/02509

§ 371 (c)(1),
(2), (4) Date: Oct. 28, 2003

(87) PCT Pub. No.: WO02/092956

PCT Pub. Date: Nov. 21, 2002

(65) Prior Publication Data

US 2004/0094332 A1 May 20, 2004

(30) Foreign Application Priority Data

Mar. 6, 2001 (EP) ..... 01302047

(51) Int. Cl.
*E21B 7/18* (2006.01)
*E21C 45/00* (2006.01)

(52) U.S. Cl. ..... 175/424; 175/67; 166/222; 299/17; 239/512; 239/521

(58) Field of Classification Search ..... 175/65, 175/67, 263, 317, 393, 424; 299/17, 29; 239/11, 589, 482, 509, 512, 521; 166/222
See application file for complete search history.

(56) References Cited

U.S. PATENT DOCUMENTS

| | | | | | |
|---|---|---|---|---|---|
| 1,512,140 | A | * | 10/1924 | Schaub | 175/40 |
| 1,852,903 | A | * | 4/1932 | Salmon | 405/428 |
| 2,028,447 | A | * | 1/1936 | Griffin | 175/407 |
| 2,963,102 | A | * | 12/1960 | Smith | 175/393 |
| 3,104,719 | A | * | 9/1963 | Fite | 166/243 |
| 3,897,836 | A | | 8/1975 | Hall et al. | |
| 4,534,427 | A | * | 8/1985 | Wang et al. | 175/67 |
| 4,708,214 | A | | 11/1987 | Krawza et al. | |
| 5,018,317 | A | * | 5/1991 | Kiyoshige et al. | 451/102 |
| 5,361,855 | A | * | 11/1994 | Schuermann et al. | 175/67 |
| 5,664,992 | A | | 9/1997 | Williams, Jr. | |
| 6,062,311 | A | | 5/2000 | Johnson et al. | |
| 6,510,907 | B1 | * | 1/2003 | Blange | 175/67 |
| 6,702,940 | B1 | * | 3/2004 | Blange | 210/222 |

FOREIGN PATENT DOCUMENTS

| | | | |
|---|---|---|---|
| WO | 00/66872 | | 11/2000 |
| WO | WO 02/092956 | A1 * | 11/2002 |

* cited by examiner

*Primary Examiner*—Jennifer H. Gay

(57) ABSTRACT

A jet cutting device having a cutter head provided with a nozzle for ejecting a stream of fluid against a body so as to create a selected cut in said body. The cutter head is provided with a deflector having a deflection surface arranged to deflect the stream of fluid ejected by the nozzle into a selected direction in accordance with the position of said cut to be created.

34 Claims, 3 Drawing Sheets

JET CUTTING DEVICE WITH DEFLECTOR

FIELD OF THE INVENTION

The invention relates to a jet cutting device comprising a cutter head provided with one or more nozzles for ejecting a stream of fluid against a body so as to create a cut in the body. The jet cutting device can be applied, for example, in the industry of machining work pieces or in the industry of rock cutting during drilling of boreholes into the earth formations.

BACKGROUND OF THE INVENTION

WO 00/66872 discloses a rock cutting device whereby a stream of drilling fluid containing abrasive particles is ejected against the borehole bottom or borehole wall by a nozzle provided at a cutter head of the device.

A problem of the known device is that the direction of the ejected stream cannot be as optimal as desired in view of limitations regarding the position of the nozzle at the cutter head. For example in certain applications it is desirable that the ejected stream passes close to, and substantially parallel to, the borehole wall in order to accurately cut the borehole circumference. However, the position of the nozzle inwardly from the outer radius of the cutter head prevents such stream direction.

SUMMARY OF THE INVENTION

In accordance with the invention there is provided a jet cutting device, comprising a cutter head provided with at least one nozzle for ejecting a stream of fluid against a body so as to create a selected cut in said body, wherein, for each nozzle, the cutter head is provided with a deflector having a deflection surface arranged to deflect the stream of fluid ejected by the nozzle into a selected direction in accordance with the position of said cut to be created.

It is thereby achieved that the ejected stream can be deflected in directions other than the direction of ejection of the stream from the nozzle.

The jet cutting device is attractive for wellbore drilling, as it allows to drill a central part of the borehole by a portion of the stream not deflected by the deflector, and to drill a radial outer part of the borehole by a portion of the stream deflected by the deflector positioned close to the borehole wall thus allowing the outer circumference of the borehole to be accurately cut.

To focus the stream and to increase the cutting efficiency, the deflector suitably has a concave deflection surface onto which the stream impacts. Alternatively, when it is desired to diverge the stream, the nozzle can be arranged to eject the stream against a convex deflection surface of the deflector.

Since for most applications the intensity of the impact force from the stream on the deflection surface varies somewhat along the surface, suitably the deflection surface has an erosion resistance which varies along the deflection surface in accordance with the variation of the impact force so that the deflection surface is substantially uniformly eroded by the stream.

BRIEF DESCRIPTION OF THE DRAWINGS

The invention will be described hereinafter in more detail and by way of example with reference to the accompanying drawings in which FIG. 1 schematically shows a longitudinal section of a jet cutting device according to an embodiment of the invention.

DETAILED DESCRIPTION OF THE INVENTION

Figure 1:
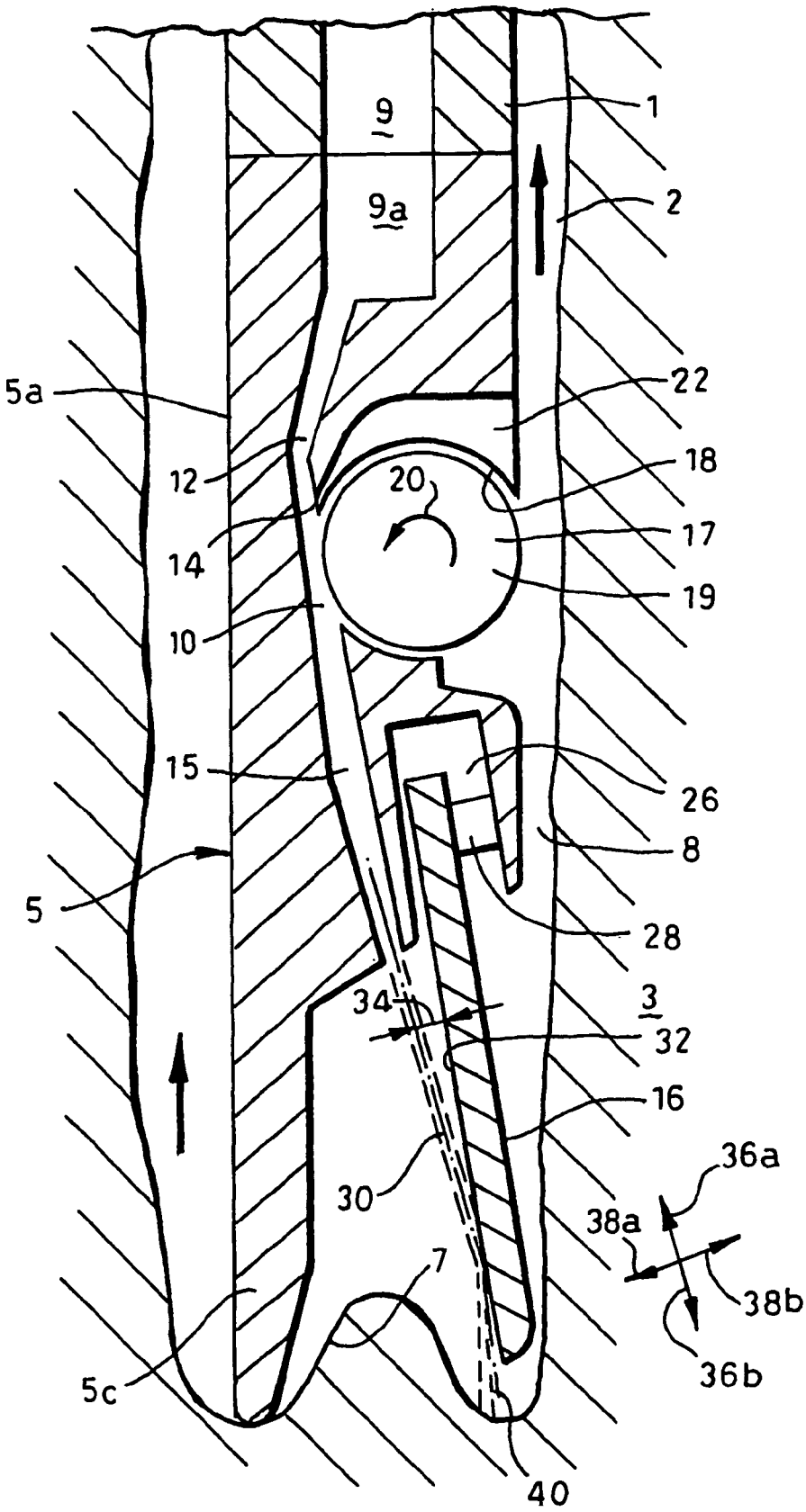

Referring to FIG. 1 there is shown a drilling assembly including a drill string 1 extending into a borehole 2 formed in an earth formation 3 and a jet cutting device 5 arranged at the lower end of the drill string 1 near the bottom 7 of the borehole 2, whereby an annular space 8 is formed between the drilling assembly 1 and the wall of the borehole 2. The drill string 1 and the jet cutting device 5 are provided with a fluid passage 9, 9*a* for drilling fluid to be jetted against the borehole bottom, as is described hereinafter. The jet cutting device 5 has a cutter head 5*a* provided with a mixing chamber 10 having a first inlet in the form of inlet nozzle 12 in fluid communication with the fluid passage 9, 9*a*, a second inlet 14 for abrasive particles and an outlet in the form of jetting nozzle 15 directed towards a deflector 16 which is described hereinafter in more detail. A longitudinal extension 5*c* of cutter head 5*a* is provided to keep the jetting deflector 16 a selected distance from the borehole bottom 7. A recess 17 is arranged in the cutter head 5*a* at the side surface thereof, which is in fluid communication with the mixing chamber 10 and with the second inlet 14.

Figure 2:
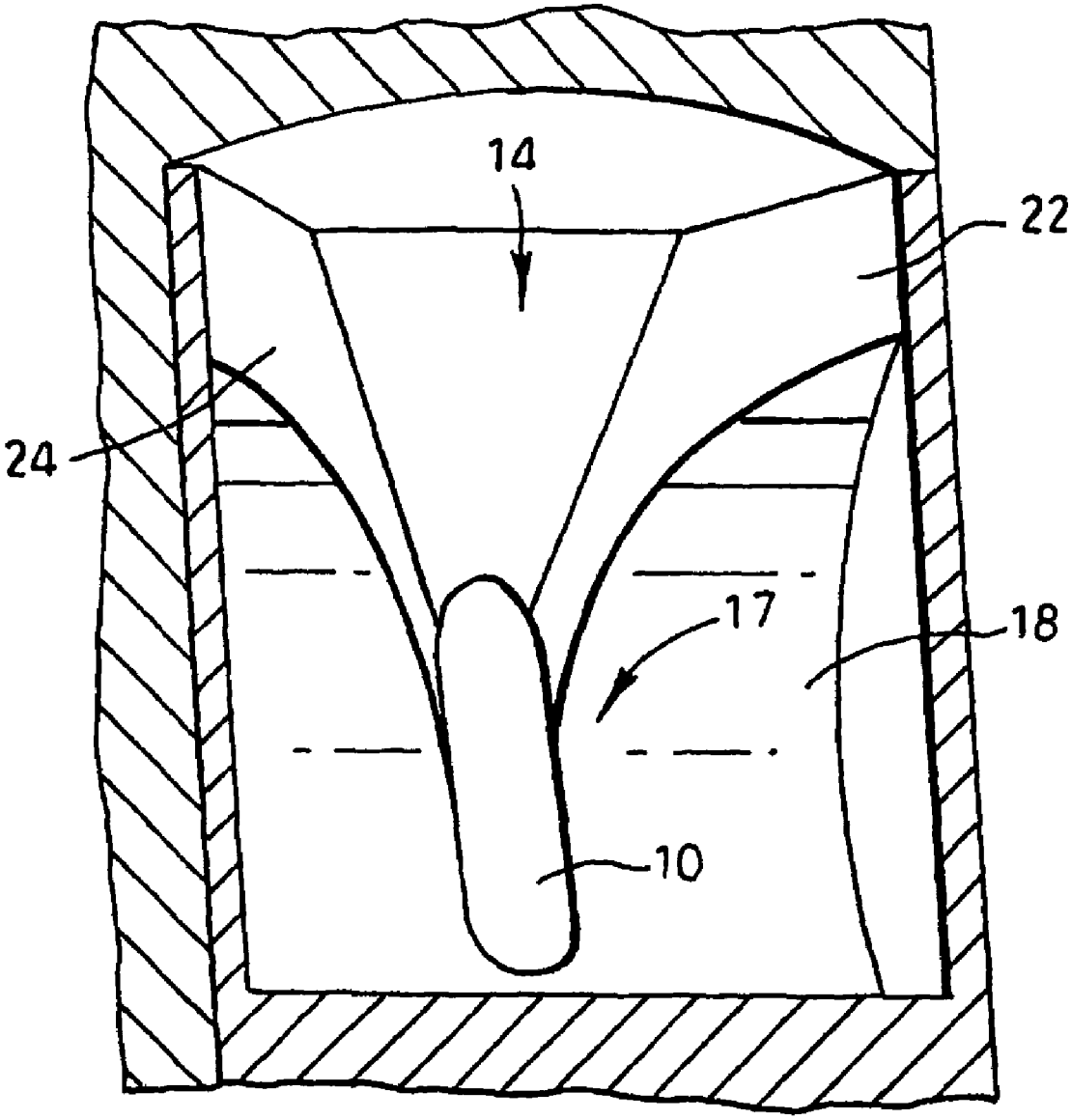
FIG. 2 schematically shows a detail of the embodiment of FIG. 1.

FIG. 2 shows a perspective view of the recess 17 whereby a semi-cylindrical side wall 18 of the recess 17 has been indicated. A cylinder 19 rotatable in direction 20 (cf. FIG. 1; in FIG. 2 the cylinder has been removed for clarity purposes) is arranged in the recess 17, the diameter of the cylinder being such that only a small clearance is present between the cylinder 19 and the side wall 18 of the recess 17. The outer surface of the cylinder 19 has been magnetised, whereby a number of N and S poles alternate in circumferential direction. The second inlet 14 and the mixing chamber 10 each have a side wall formed by the outer surface of the cylinder 19. Furthermore, the second inlet 14 has opposite side walls 22, 24 which converge towards the mixing chamber 10 and which extend substantially perpendicular to the side wall 18.

The deflector 16 extends into a lower recess 26 of the cutter head 5*a* in a manner allowing movement of the deflector 16 relative to the cutter head 5*a*. A control means in the form of actuator 28 is arranged in the lower recess 26 to support the deflector 16 and to control movement of the deflector 16 relative to the cutter head 5*a*. The deflector 16 is arranged so that during operation of the jet cutting device 5 a stream of fluid 30 ejected by the nozzle 15 impacts onto inner surface 32 of the deflector at a selected angle 34. The inner surface 32 is preferably made of an erosion resistant material like Tungsten Carbide.

The actuator 28 is capable of moving the deflector in opposite directions 36*a*, 36*b* which are substantially parallel to the deflector inner surface 32 and opposite directions 38*a*, 38*b*, which are substantially perpendicular to the deflector inner surface 32. Furthermore the actuator 28 is capable of rotating the actuator so as to change the angle 34 at which the stream 30 impacts on the deflector inner surface 32.

Figure 3:
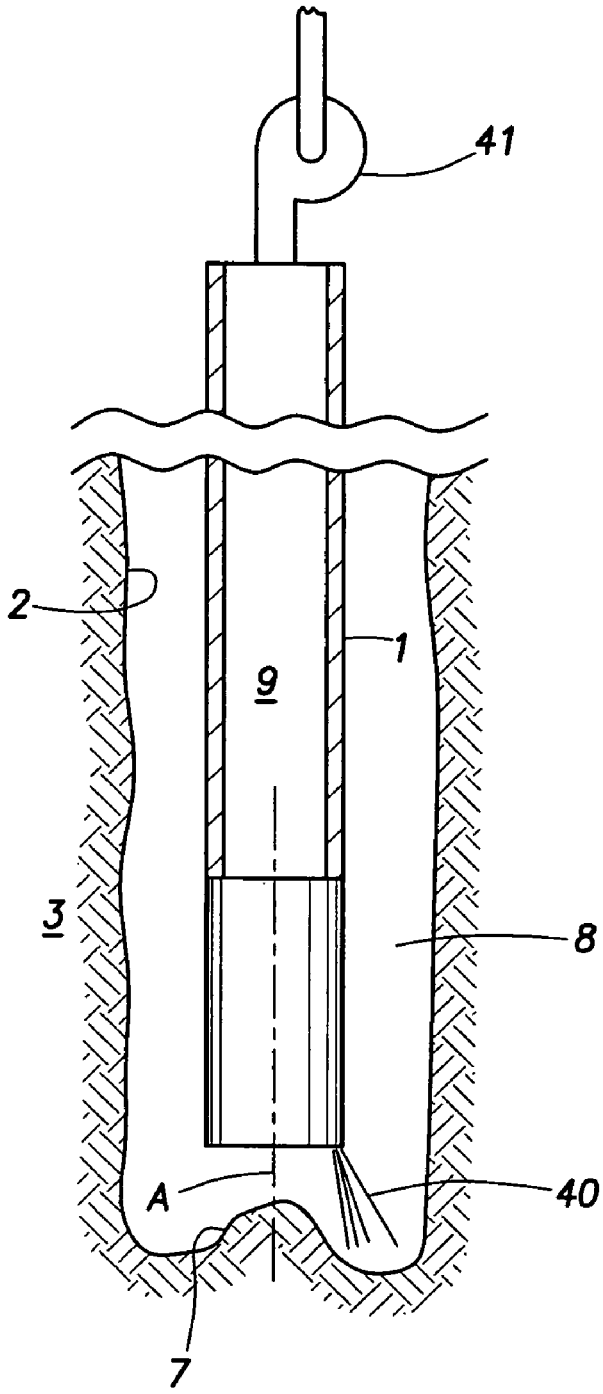
FIG. 3 schematically shows a longitudinal section of a drilling assembly including the jet cutting device of FIG. 1.

During normal operation of the drilling assembly 1, a stream of drilling fluid initially containing abrasive particles is pumped via the fluid passage 9, 9*a* and the inlet nozzle 12 into the mixing chamber 10 employing pump means 41 as schematically shown in FIG. 3. The abrasive particles include a magnetically active material such as martensitic steel, and typical abrasive particles are martensitic steel shot or grit. The stream flows through the jetting nozzle 15 in the form of a jet stream 30 against the deflector 16 which deflects the stream 30 to form deflected stream 40 impacting against the borehole bottom 7. The direction of deflected stream 40 is determined by the angle of impact 34, the deflector shape and the deflector orientation.

After all abrasive particles have been pumped through the fluid passage 9, 9*a*, drilling fluid which is substantially free of abrasive particles is pumped through the passage 9, 9*a* and the inlet nozzle 12 into the mixing chamber 10.

By the impact of the jet stream 40 against the borehole bottom 7, rock particles are removed from the borehole bottom 7. The drill string us simultaneously rotated about longitudinal axis A (see FIG. 3) so that the borehole bottom 7 is evenly eroded resulting in a gradual deepening of the borehole. The rock particles removed from the borehole bottom 7 are entrained in the stream which flows in upward direction through the annular space 8. As the stream passes the cylinder 19 the abrasive particles are attracted by the magnetic forces induced by cylinder 19, which magnetic forces thereby separate the abrasive particles from the stream and move the particles onto the outer surface of the cylinder 19. The cylinder 19 is induced to rotate a) due to frictional forces exerted to the cylinder by the stream of drilling fluid flowing into the mixing chamber, b) due to frictional forces exerted to the cylinder by the stream flowing through the annular space 8, and c) due to the high velocity flow of drilling fluid through the mixing chamber 10 which generates a hydraulic pressure in the mixing chamber 10 significantly lower than the hydraulic pressure in the annular space 8. The abrasive particles adhered to the outer surface of the cylinder 16 thereby move through the second inlet 14 in the direction of the mixing chamber 10. The converging side walls 22, 24 of the second inlet 14 guide the abrasive particles into the mixing chamber 10. Upon arrival of the particles in the mixing chamber 10 the stream of drilling fluid ejected from the inlet nozzle 12 removes the abrasive particles from the outer surface of the cylinder 19 whereafter the particles are entrained into the stream of drilling fluid.

The remainder of the stream flowing upwardly through the annular space 8 is substantially free of abrasive particles and continues flowing upwardly to surface where the drill cuttings can be removed from the stream. After removal of the drill cuttings the drilling fluid is pumped through the fluid passage 9, 9*a* and the inlet nozzle 12, into the mixing chamber 10 so as to entrain again the abrasive particles, etc.

When the area of deflector surface 32 where the stream 30 impacts becomes worn, the actuator 28 is induced to move the deflector 16 either in direction 36*a* or 36*b* so as to displace said area away from the location of impact and to position a new area of deflector surface 32, not worn, at the location of impact. In this manner it is achieved that the life time of the deflector is increased.

When it is desired to change the direction of the deflected stream 40, the actuator 28 is induced to rotate the deflector so as to change the angle 34 at which the stream 34 impacts on the deflector.

Furthermore when it is desired to increase the diameter of the borehole 2 drilled, the actuator 28 is induced to move the deflector 16 in the direction 38*b* thereby increasing the distance between the deflector 16 and the stream 30. Conversely, when it is desired to decrease the diameter of the borehole 2 drilled, the actuator 28 is induced to move the deflector 16 in the direction 38*a* thereby decreasing the distance between the deflector 16 and the stream 30.

What is claimed is:

1. A jet cutting device for cutting a borehole in a body, comprising a cutter head provided with a nozzle for ejecting a stream of fluid against said body so as to create a selected cut in said body, the cutter head being rotatable in the borehole about a longitudinal axis, wherein the cutter head is provided with a deflector having a deflection surface arranged to deflect the stream of fluid ejected by the nozzle into a selected direction in accordance with the position of said cut to be created, wherein the deflection surface is arranged to deflect the stream of fluid in a direction more parallel to the longitudinal axis than the direction of ejection of the stream from the nozzle.

2. The jet cutting device of claim 1, wherein pump means is arranged to induce the stream of fluid including abrasive particles through the nozzle.

3. The jet cutting device of claim 2, wherein the deflection surface is concave.

4. The jet cutting device of claim 2, wherein the impact force of the stream on the deflection surface varies along the deflection surface, and wherein the deflection surface has an erosion resistance which varies along the deflection surface in accordance with the variation of the impact force of the stream on the deflection surface so that the deflection surface is substantially uniformly eroded by the stream.

5. The jet cutting device of claim 2, wherein the deflector is movable relative to the cutter head, and the jet cutting device further includes control means for controlling movement of the deflector relative to the cutting head.

6. The jet cutting device of claim 2, wherein the cutter head forms part of a drill string for drilling a borehole into an earth formation, and wherein the nozzle is arranged to eject the stream of fluid including abrasive particles into the borehole so as to further drill the borehole.

7. The jet cutting device of claim 2, wherein the stream of fluid comprises a stream of liquid.

8. The jet cutting device of claim 2, wherein the deflection surface has an erosion resistance which varies along the deflection surface.

9. The jet cutting device of claim 8, wherein the erosion resistance varies along the deflection surface so that the deflection surface is substantially uniformly eroded by the stream.

10. The jet cutting device of claim 1, wherein the deflection surface is concave.

11. The jet cutting device of claim 10, wherein the impact force of the stream on the deflection surface varies along the deflection surface, and wherein the deflection surface has an erosion resistance which varies along the deflection surface in accordance with the variation of the impact force of the stream on the deflection surface so that the deflection surface is substantially uniformly eroded by the stream.

12. The jet cutting device of claim 10, wherein the deflector is movable relative to the cutter head, and the jet cutting device further includes control means for controlling movement of the deflector relative to the cutting head.

13. The jet cutting device of claim 10, wherein the cutter head forms part of a drill string for drilling a borehole into an earth formation, and wherein the nozzle is arranged to eject the stream of fluid including abrasive particles into the borehole so as to further drill the borehole.

14. The jet cutting device of claim 10, wherein the deflection surface has an erosion resistance which varies along the deflection surface.

15. The jet cutting device of claim 14, wherein the erosion resistance varies along the deflection surface so that the deflection surface is substantially uniformly eroded by the stream.

16. The jet cutting device of claim 1, wherein the impact force of the stream on the deflection surface varies along the deflection surface, and wherein the deflection surface has an erosion resistance which varies along the deflection surface in accordance with the variation of the impact force of the stream on the deflection surface so that the deflection surface is substantially uniformly eroded by the stream.

17. The jet cutting device of claim 16, wherein the deflector is movable relative to the cutter head, and the jet cutting device further includes control means for controlling movement of the deflector relative to the cutting head.

18. The jet cutting device of claim 16, wherein the cutter head forms part of a drill string for drilling a borehole into an earth formation, and wherein the nozzle is arranged to eject the stream of fluid including abrasive particles into the borehole so as to further drill the borehole.

19. The jet cutting device of claim 1, wherein the deflector is movable relative to the cutter head, and the jet cutting device further includes control means for controlling movement of the deflector relative to the cutting head.

20. The jet cutting device of claim 19, wherein the control means is arranged to move the deflector so as to displace a first portion of the deflection surface away from the location at which the stream impacts on the deflection surface, and to position a second portion of the deflection surface at said location.

21. The jet cutting device of claim 20, wherein the cutter head forms part of a drill string for drilling a borehole into an earth formation, and wherein the nozzle is arranged to eject the stream of fluid including abrasive particles into the borehole so as to further drill the borehole.

22. The jet cutting device of claim 19, wherein the control means is arranged to move the deflector so as to change the angle at which said stream impacts on the deflector.

23. The jet cutting device of claim 22, wherein the cutter head forms part of a drill string for drilling a borehole into an earth formation, and wherein the nozzle is arranged to eject the stream of fluid including abrasive particles into the borehole so as to further drill the borehole.

24. The jet cutting device of claim 19, wherein the control means is arranged to move the deflector in a translating movement so as to change the distance between the deflector and said stream.

25. The jet cutting device of claim 24, wherein the cutter head forms part of a drill string for drilling a borehole into an earth formation, and wherein the nozzle is arranged to eject the stream of fluid including abrasive particles into the borehole so as to further drill the borehole.

26. The jet cutting device of claim 19, wherein the cutter head forms part of a drill string for drilling a borehole into an earth formation, and wherein the nozzle is arranged to eject the stream of fluid including abrasive particles into the borehole so as to further drill the borehole.

27. The jet cutting device of claim 1, wherein the cutter head forms part of a drill string for drilling a borehole into an earth formation, and wherein the nozzle is arranged to eject the stream of fluid including abrasive particles into the borehole so as to further drill the borehole.

28. The jet cutting device of claim 27, wherein the nozzle is arranged to drill a central part of the borehole by a portion of the stream ejected by the nozzle not deflected by the deflector, and to drill a radial outer part of the borehole by a portion of the stream deflected by the deflector positioned close to the borehole.

29. The jet cutting device of claim 1, wherein the deflector is movable relative to the cutter head, and the jet cutting device further includes an actuator for controlling movement of the deflector relative to the cutting head.

30. The jet cutting device of claim 29, wherein the actuator is arranged to move the deflector so as to displace a first portion of the deflection surface away from the location at which the stream impacts on the deflection surface, and to position a second portion of the deflection surface at said location.

31. The jet cutting device of claim 29, wherein the actuator is arranged to move the deflector so as to change the angle at which said stream impacts on the deflector.

32. The jet cutting device of claim 29, wherein the actuator is arranged to move the deflector in a translating movement so as to change the distance between the deflector and said stream.

33. The jet cutting device of claim 1, wherein the deflection surface has an erosion resistance which varies along the deflection surface.

34. The jet cutting device of claim 33, wherein the erosion resistance varies along the deflection surface so that the deflection surface is substantially uniformly eroded by the stream.

* * * * *